United States Patent [19]

Hart

[11] 4,092,950

[45] June 6, 1978

[54] INTERNAL PIPE COATING APPARATUS

[75] Inventor: Robert J. Hart, Tulsa, Okla.

[73] Assignee: Commercial Resins Company, Tulsa, Okla.

[21] Appl. No.: 808,200

[22] Filed: Jun. 20, 1977

[51] Int. Cl.[2] ..... B05C 7/02; B05C 7/08; B05C 19/00

[52] U.S. Cl. ..... 118/8; 118/306; 118/308; 118/DIG. 10

[58] Field of Search ..... 118/306, DIG. 10, 9, 118/8, 317, 308, 310, 312, DIG. 5, 11; 51/411; 15/104.5

[56] References Cited

U.S. PATENT DOCUMENTS

| | | | |
|---|---|---|---|
| 2,998,800 | 9/1961 | Vernooy | 118/306 X |
| 3,720,533 | 3/1973 | Gallagher | 118/308 X |
| 3,740,833 | 6/1973 | Hanson et al. | 118/308 X |
| 3,967,584 | 7/1976 | Hasegawa et al. | 118/306 X |

*Primary Examiner*—John P. McIntosh
*Attorney, Agent, or Firm*—William S. Dorman

[57] ABSTRACT

An internal pipe coating apparatus for coating the interior surface of uncoated weld joints in an otherwise internally coated pipeline comprising a frame having wheels at the forward and rear ends thereof, the forward end being oriented or directed towards the uncoated weld joint to be coated, and a drive motor for driving one pair of wheels to move the coating apparatus towards and beyond the uncoated weld joint. A feeler mechanism is located at the rear end of the apparatus. Means are provided to elevate the feeler mechanism into contacting position against the internal surface of the pipe when the drive motor is actuated to move the apparatus in a forward direction. The feeler mechanism comprises a pair of electrically conductive arms adapted to bear against the internal surface of the pipe and to create a completed circuit through the pipe when the feeler arms engage the bare surface of the uncoated weld joint to stop the drive motor. A rotating hollow shaft is also located at the rear end of the coating apparatus. This hollow rotating shaft is provided with a hollow hub and a plurality of hollow radiating arms adapted to spray powder on the uncoated weld joint, which has been previously heated in a conventional manner. A spin motor is provided to rotate the shaft and hub. The spin motor is actuated when the coating cycle is initiated. A powder suspension device is also located on the coating apparatus and a fan or blower is actuated in response to the actuation of the spin motor to provide air under pressure to the powder suspension device to suspend powder therein. A valve is located on the outlet of the powder suspension device and a motor is provided to spin the hollow shaft and the hub. After the spinning motor has been actuated and after the fan has been actuated to suspend powder in the powder suspension device, the valve from the powder suspension device is then opened to provide a stream of powder to the hollow shaft so that a suspension of powder passes out of the hollow arms by centrifugal force to coat the heated weld joint. After a predetermined period of time, the valve from the powder suspension device is closed, the fan motor is turned off, and finally the spin motor is shut off.

5 Claims, 9 Drawing Figures

INTERNAL PIPE COATING APPARATUS

BACKGROUND OF THE INVENTION

1. Field of the Invention

The present invention relates to an internal coating apparatus and, more particularly, to a coating apparatus designed to coat uncoated weld joints on the interior of an otherwise coated pipeline.

2. The Prior Art

Many devices have been designed and proposed for the coating of uncoated weld joints on the interior surface of a pipeline which is otherwise coated except for the weld joints. However, it is difficult to position the coating apparatus properly so that the spraying mechanism is correctly oriented with respect to the uncoated weld joint.

SUMMARY OF THE INVENTION

The present invention relates to an internal coating apparatus for coating the uncoated weld joints in the interior of an otherwise internally coated pipeline. The apparatus includes a frame which is supported by wheels at the forward and rear end thereof. Means are provided for driving a pair of wheels through a drive motor so that the apparatus moves towards and beyond an uncoated weld joint. A feeler mechanism is located at the rear end of the coating apparatus. The feeler mechanism consists of a pair of conductive feeler arms which, when positioned against the surface of the pipe, will cause a completed circuit when the two feeler arms simultaneously come in contact with uncoated portions of the pipe as, for example, at the location of an uncoated weld joint. Means are provided to elevate the feeler means into contact with the interior surface of the pipe in response to the actuation of the drive motor which drives the wheels. As soon as the feeler arms contact the bare surface of the weld joint, the drive motor will be instantly stopped and a brake mechanism associated with the drive motor will be engaged to bring the apparatus to a complete stop. At this time, the apparatus is in condition for the coating operation. The operator iniates the action of the coating operation by depressing a button which, first of all, commences to spin, through a spin motor, a hollow shaft at the rear end of the coating apparatus. The hollow shaft has a hollow hub at the rear end thereof and a plurality of hollow arms radiate out from the hub. A powder suspension device is also located on the coating apparatus and a fan motor is actuated to provide a stream of air under pressure into the interior of the powder suspension device to suspend powder therein. A valve is located on the outlet of a powder suspension device and, when opened, will provide a stream of powder suspension to the hollow rotating shaft. When the operator pushes the button which starts the coating operation, the spin motor is turned on first; secondly, the fan motor is turned on to create the powder suspension within the powder suspension device and, thirdly, the valve at the outlet from the powder suspension device is opened to allow a stream of powder suspension to pass into the rotating shaft and then outwardly, by centrifugal force, through the hollow radiating arms on the hollow hub. After a predetermined period of time, the coating operation is caused to cease by first shutting the valve from the powder suspension device to the hollow rotating shaft; secondly, by shutting off the fan motor which creates the powder suspension; and thirdly, by turning off the spin motor. The means for introducing powder from the valve into the interior of the rotating hollow shaft is a tube which is spaced from the hollow rotating shaft to create an annular zone. The centrifugal force of the powder passing out of the radial arms causes air to pass through the annular zone between the tube and the rotating shaft so that air is mixed with the powder as it passes out of the radial arms. When the coating operation is over, the operator, by reversing the powder through the drive motor can cause the coating apparatus to move in a reverse direction away from the weld joint which has just been coated.

DETAILED DESCRIPTION OF THE PREFERRED EMBODIMENTS

Figure 1:
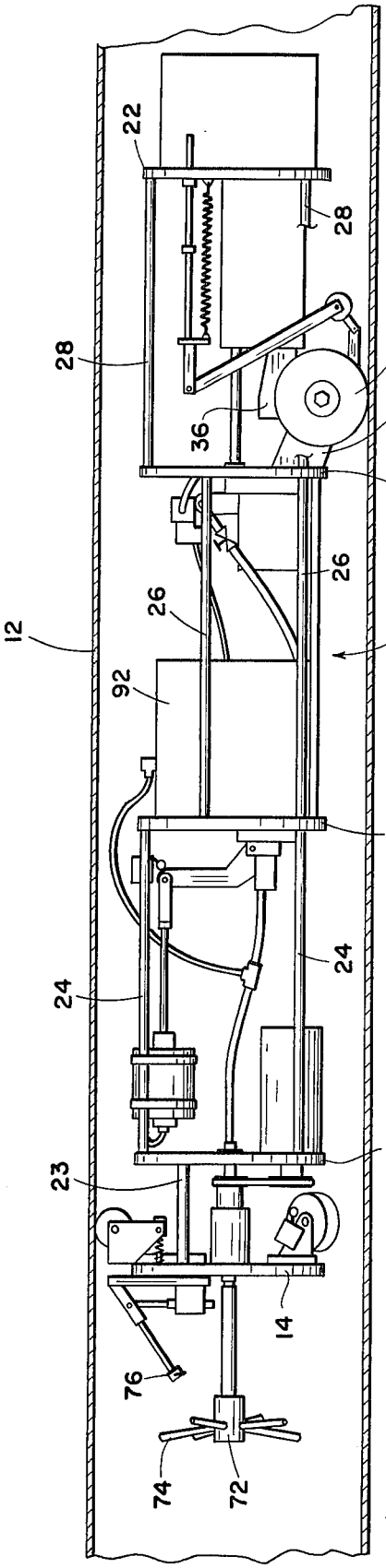
FIG. 1 is a longitudinal side view of a coating apparatus constructed in accordance with the present invention showing the same mounted inside of a pipe which is in section.
Figure 2A:
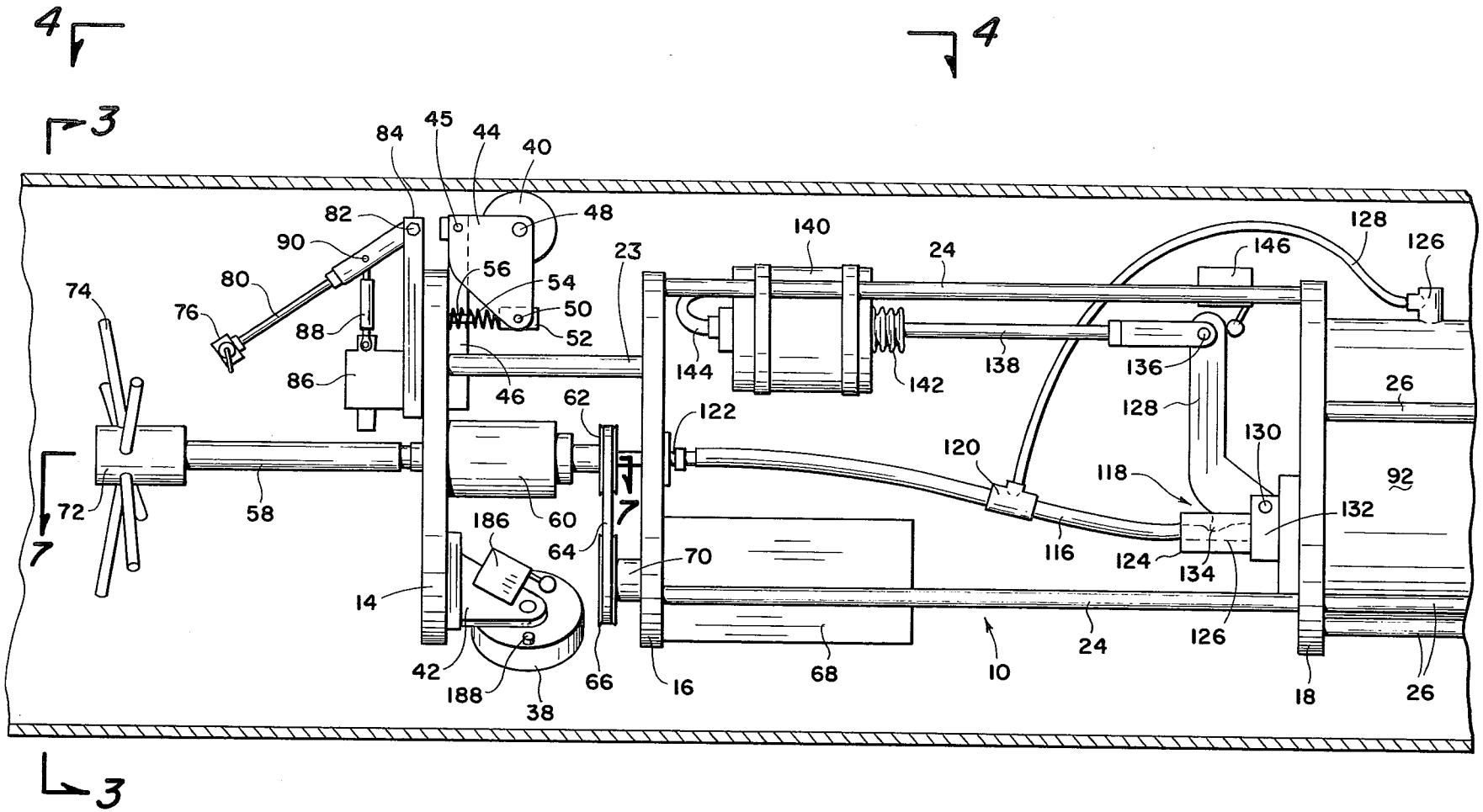
FIGS. 2A and 2B are left and right-hand portions, respectively, of FIG. 1 on an enlarged scale.
Figure 2B:
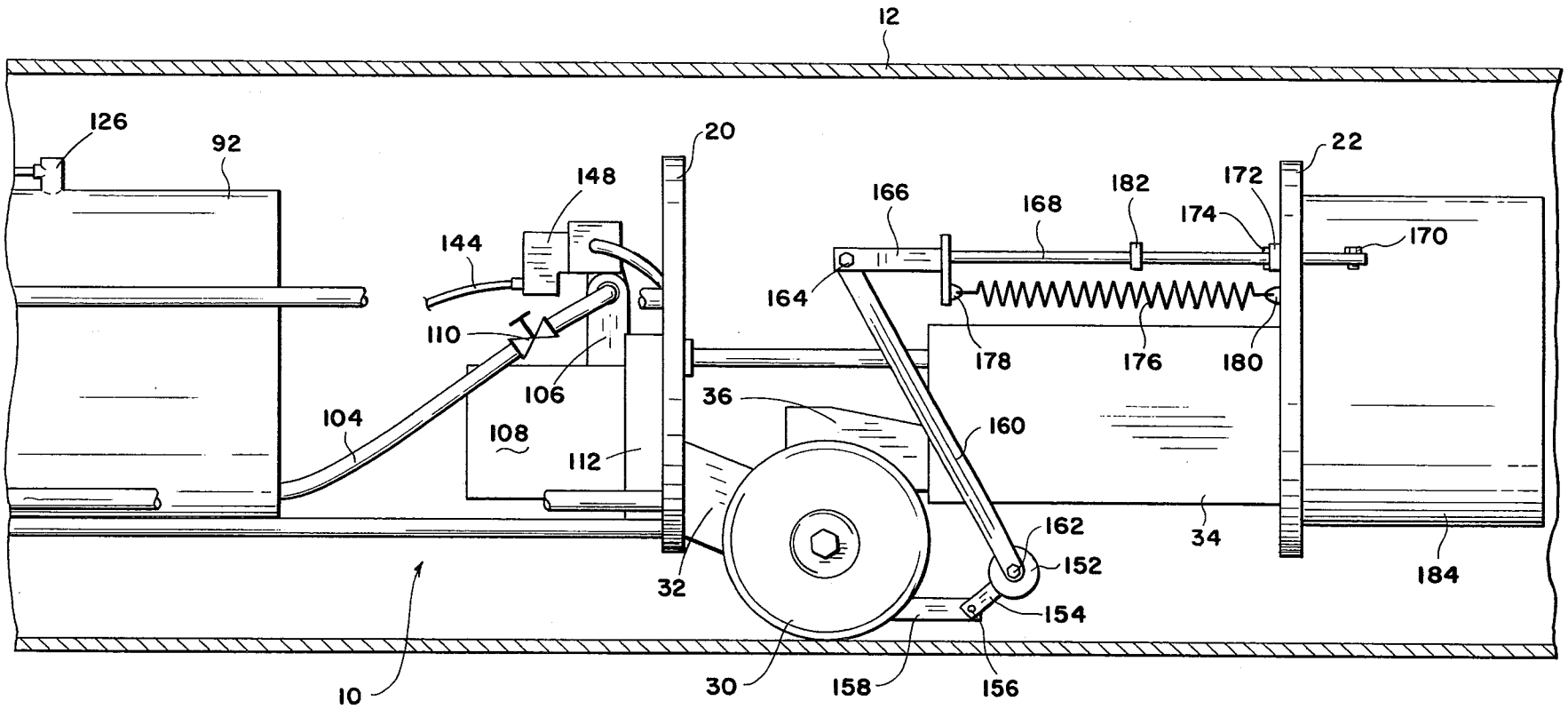

Referring to the drawings in detail, FIG. 1 shows an internal coating device generally designated by the reference character 10 located inside a pipe 12, one of whose internal welded joints is to be coated. The coating apparatus 10 includes a plurality of circular plates 14, 16, 18, 20 and 22 interconnected by longitudinally extending rods 23, 24, 26 and 28, some of which are broken away and some of which do not appear in FIG. 1 because they are behind other longitudinal rods. A pair of drive wheels 30 (only one of which is shown in FIG. 1 and 2B) are rotatably mounted on a pair of arms 32 (only one of which is shown in these figures) connected to the circular plate 20. An electric motor 34, having an associated brake mechanism (not shown), is adapted to drive the wheels 30 through a suitable gear box 36. When the electric motor 34 is energized, the brake is released and the motor will drive the wheels 30 so as to move the apparatus 10 towards the right with respect to FIG. 1. When the motor 34 is de-energized, the brake is simultaneously engaged to stop the wheels 30.

Figure 3:
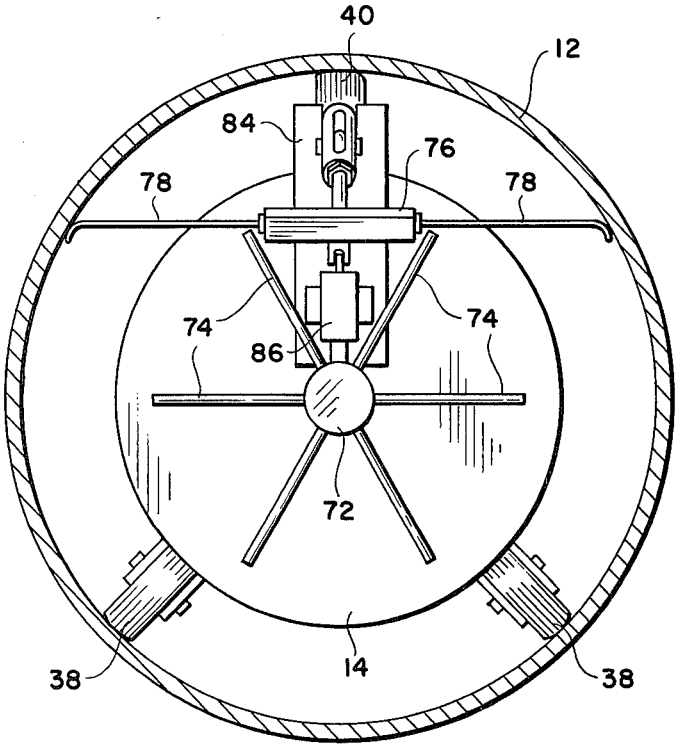
FIG. 3 is a front view as the apparatus would appear looking along line 3—3 of FIG. 2A.
Figure 4:
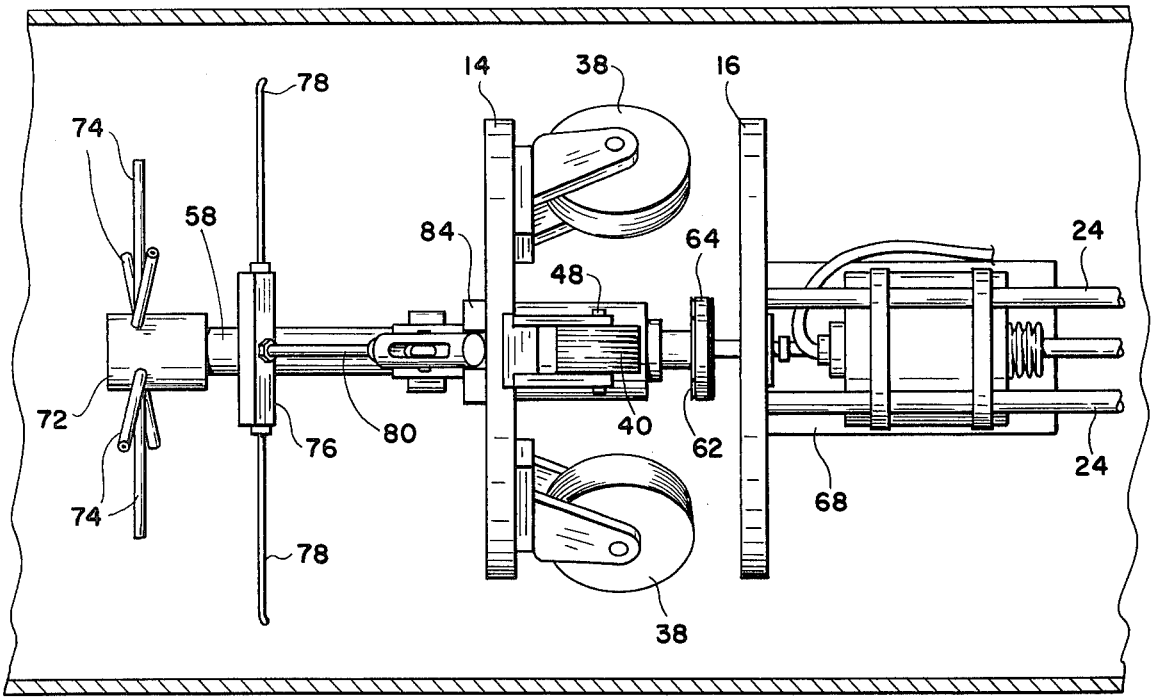
FIG. 4 is a partial plan view of the forward end of the coating apparatus as would appear taken along line 4—4 of FIG. 2A.

The rear or left-hand end of the coating apparatus 10 is provided with a pair of lower wheels 38 which are disposed angularly with respect to the wheels 30, but which ride against the surface of the pipe 12 as best shown in FIG. 3. A third wheel 40 is mounted on the upper portion of the rear end of the coating apparatus 10 to ride against the upper surface of the pipe 12 on the inside thereof. The lower wheels 38 are pivotally mounted on brackets 42 which connect to the front of the circular plate 14. The upper wheel 40, however, is mounted on a pivotal bracket 44 which is pivotally connected at 45 to a vertical plate 46 attached to the rear of the plate 14. The wheel 40 is rotatably mounted on the axis 48. The lower end of the pivotal bracket 44 is pivotally connected at 50 to a block 52, which is urged in a counterclockwise direction by the spring 54 which extends around a rod 56 and into engagement with the left-hand end of the block 52.

At the rear end of the coating apparatus 10 is located a rotatable hollow shaft 58 which connects through a journal 60 to a pulley 62. A belt 64 places the pulley 62 in driving relation with a lower pulley 66. The lower pulley 66 is driven by a spin motor 68 through a shaft 70, the spin motor 68 being connected to the front of the plate 16 and being otherwise supported by suitable rods (not shown). A hollow hub 72 is connected to the left-hand end of the hollow shaft 58 and a plurality of hollow radial arms 74 extend outwardly from the hub 72 and are in fluid communication therewith.

The rear end of the coating apparatus is also provided with a feeler 76 composed of two outwardly extending metallic arms 78 which are adapted, in the position shown in FIG. 3, to contact the inner surface of the pipe 12 for a purpose which will hereinafter appear. The feeler 76 is mounted at the end of the arm 80 which is pivotally connected at 82 to a vertical plate 84. The vertical plate, in turn, is connected to the rear surface of the circular plate 14. The solenoid 86 is also connected to plate 84 and its actuator arm 88 is pivotally connected at its upper end 90 intermediate the ends of the arm 80. In the position shown in FIG. 2A, the solenoid 86 is in its de-actuated condition so that the feeler 76 is at its lowermost position. In the FIG. 3 position, however, the solenoid 86 has been actuated so that the feeler 76 is in its uppermost position with the feeler arms 78 contacting the inner surface of the pipe 12.

Figure 6:
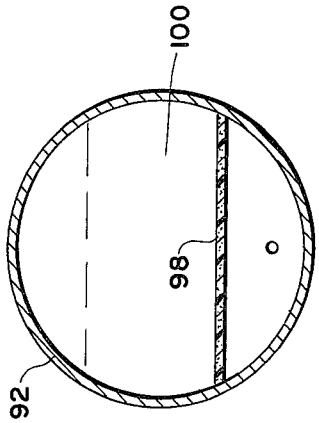
FIG. 6 is a cross-sectional view taken along section line 6—6 of FIG. 5.
Figure 5:
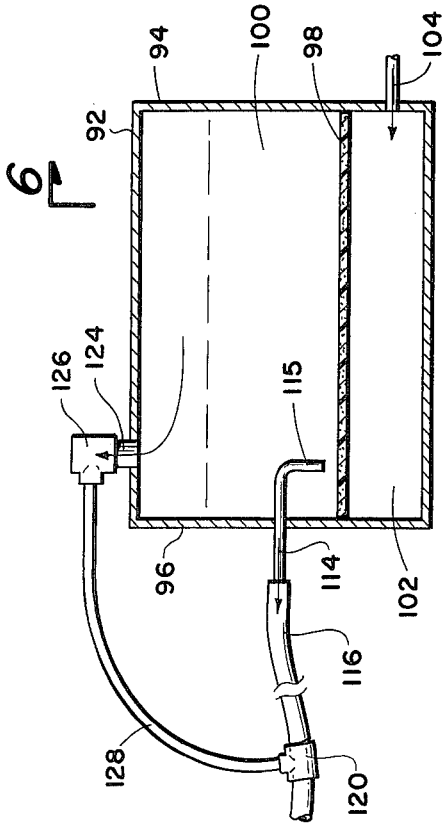
FIG. 5 is a semi-diagramatic view of the powder dispenser and associated elements shown in FIGS. 1, 2A and 2B.

Referring now to FIGS. 1, 2A, 2B, 5 and 6, a powder suspension device 92 is mounted on the apparatus 10 between the plates 18 and 20 and closely adjacent the plate 18. As best shown in FIGS. 5 and 6, the powder suspension device 92 is in the form of a closed hollow horizontal cylinder having closed ends 94 and 96 and having a horizontally disposed plate 98 mounted therein. The plate 98 is in the form of a porous or foraminous plastic plate and upon which a quantity of powder 100 is located. An open space 102 beneath the plate 98 permits the introduction of air beneath the plate 98 through a conduit 104 from a blower (later to be described) the air introduced into the chamber 102 passes through the pores in the porous plate 98 and places the powder 100 in suspension above the plate.

The conduit 104 connects with an outlet 106 of a blower 108 through a manual valve 110 which is normally open. The blower 108 is powered by a conventional blower motor 112 (the details of which are not shown) in much the same manner as a vacuum cleaner.

The outlet from the powder suspension device 92 consists of an inverted L-shaped tube 114 whose lower end or leg 115 is downwardly directed in the bed of powder 100, the lower end of the leg 115 terminating at a short distance above the plate 98. The outer end of the tube 114 connects with a hose 116 which passes through a pinch valve 118, later to be described, through a tee connection 120 and to a tube 122 which feeds a powder suspension to the hollow shaft 58 in a manner later to be described. The top of the powder suspension device is provided with a bleed opening 124 in which is mounted a fitting 126. A smaller hose 128 connects from the fitting 126 to the tee 120 so that any stream of powder coming out of the bleed opening 124 will join the main stream of powder in the hose 116.

The pinch valve 118 includes an elongated member or trough 124 against the bottom of which 126 the hose 116 rests. The upper end of the trough 124 is open and an arm 128 is pivotally received therein, the lower end of the arm 128 being pivotally connected at 130 to block 132 which is connected to the plate 118 and which supports the trough 124. The arm 128 is provided with a protuberance or nose 134 which is adapted to engage the upper portion of the tube 116 and squeeze it against the bottom 126 of the trough 124 when the arm 128 is in its relative counterclockwise position. The upper end of the arm or lever 128 is pivotally connected at 136 to a rod 138 which extends into an air actuater 140. The inner end of the rod 138 connects with a piston (not shown) mounted in the air actuater 140. The air actuater is provided with a spring loaded bellows 142 which is constantly urging the rod 138 towards the left such that the pinch valve 118 tends to remain closed. If, however, air is introduced under pressure into the actuater 140 through the conduit 144, the piston (not shown) within the actuater 140 will urge the rod 138 towards the right against the action of the spring loaded bellows 142. When the rod 138 is urged to the right, the arm 128 will be pivoted clockwise to open the pinch valve 118 thereby allowing a stream of powder suspension to pass outwardly from the powder suspension device 92 through the hose 116. The upper end of the arm 128 is adapted to engage a micro-switch 146 to turn on a light (later to be described) thereby indicating that the pinch valve is open and that powder is being supplied to the sprayer head.

The conduit 144, referred to above, extends from the left-hand end of the actuater 140 to a solenoid valve 148 which connects with the outlet 106 on the blower 108. When the solenoid (not shown) within the solenoid valve 148 is energized, the valve 148 will be open and air will pass through the conduit 144 to operate the actuater 140 and to open the pinch valve 118 as described above.

Figure 7:
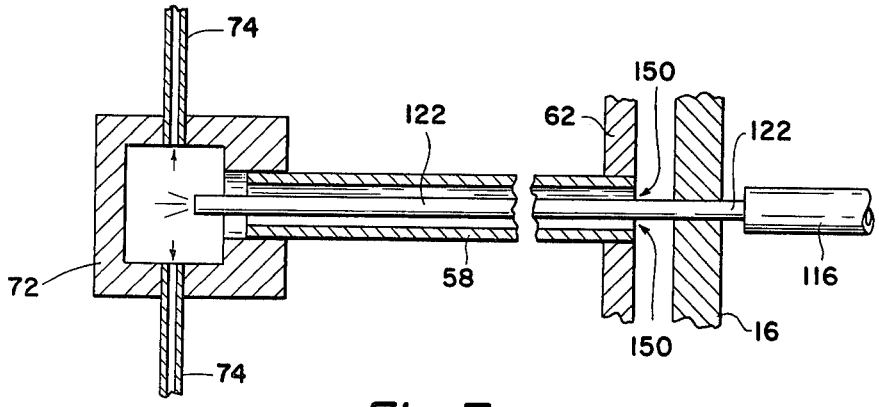
FIG. 7 is a sectional view taken along section line 7—7 of FIG. 2A.

Referring now to FIG. 7, the tube or conduit 122 extends through the circular plate, into the interior of the hollow shaft 58 and into the hollow hub 72. When the hollow shaft 58 is rotating and the hub is rotating also, the powder suspension will be thrown out of the arms 74 by centrifugal force. This centrifugal force will create a suction affect within the interior of the dispensing assembly such that air will be drawn into the annular space between the rotating shaft 58 and the tube 122 as indicated by the arrows 150.

The motor 34 is operable to rotate the wheels 30 to drive the apparatus 10 towards the right as described above, or, if desired, to turn the wheels 30 in the opposite direction. If, for any reason, the motor 34 should not operate properly, or if there were a power failure, the drag created by the wheels 30 would be too great to permit the manual withdraw of the apparatus 10. Accordingly, a pair of auxiliary wheels 152 (only one of which is shown) are pivotally mounted on arms 154. The arms 154 (only one of which is shown) are pivotally connected at 156 to horizontal arms 158 (only one of which is shown) which also connect with the support arms 32. Another pair of arms 160 (only one of which is shown) are pivotally connected at their lower ends to the axes of rotation 162 of the auxiliary wheels 152. The upper ends of the arms 160 are pivotally connected at 164 to a yoke 166. The yoke 166 connects with a rod 168 which passes through the plate 22. A bolt 170, or other convenient connecting element, is located at the right-hand end of the rod 168 to permit attachment to a cable or the like. At its point of passing through the plate 22, the rod 168 passes through a collar 172 which is attached to the plate 22. A shear pin 174 passes through a convenient hole in the rod 168 and engages the collar 172. A spring 176 engages a suitable eye 178 on the yoke and another eye 180 attached to the plate 22 so as to urge the yoke 166 towards the right with respect to FIG. 2B. If, as indicated above, it is desirous to pull the apparatus 10 manually from the pipe 12, the cable (not shown) which is attached to the rod 168 through the connection 170 is pulled or yanked towards the right so as to break or shear the shear pin 174; at this point, the spring 176 will urge the rod 168 towards the right until a stop 182 mounted on the rod 168 engages the collar 172. The foregoing action, involving the movement of the rod 168 to the right, will cause the arm 154 to pivot downwardly until the auxiliary wheels 152 engage the inner lower surface of the pipe 12, thereby slightly elevating the wheels 30 out of engagement with the pipe. Now, the apparatus can be pulled with the cable (not shown) and the apparatus will roll towards the right on the auxiliary wheels 152.

The housing 184 will house the electrical controls that have to be carried by the apparatus 10. However, it should be understood that an external electrical control panel or module will be located outside of the pipe 12 and the electrical cables (not shown) will extend from the external console to the control housing 184. Various electrical connections (not shown) will also extend from the housing 184 to the various electrical components, previously described, which are mounted on the apparatus 10.

As indicated above, when the coating apparatus 10 is moving towards the right within the pipe, the solenoid 86 will be actuated such that the feeler 76 will be in its upper position as shown in FIG. 3. The electrically conductive arms 78 represent the open ends of a circuit which connect with a relay (not shown) which will serve to shut off power to the drive motor 34 (in a manner later to be described) when the two elements 78 are electrically connected to each other. It should be understood that the interior (as well as the exterior) of the pipe 12 will be coated except for the weld joints which are to be coated by the apparatus of the present invention. It should also be understood that the weld joint will have been previously heated in any suitable manner such that, when the powder coating material is sprayed on the hot weld joint by the hollow arms 74, the coating material will melt and cover the weld joint. Thus, if the coating apparatus, as shown in the drawings, is moving to the right and one of the arms 78 only should contact a holiday or other bare spot in the coating on the interior of the pipe 12, nothing will happen. However, if both arms 78 should contact bare spots simultaneously, as would generally only occur when the arms 78 engage an uncoated weld joint, the circuit to the relay (not shown) previously described would be completed and the motor 34 would be instantly stopped so that the arms 74 would be properly positioned for spraying powder on the uncoated weld joint. As a guide to determining how far into the pipe the apparatus 10 has proceeded, a micro-switch 186 is mounted on the bracket 42 which supports one of the wheels 38. A lug 188 is also mounted on the wheel 38 so as to engage the micro-switch 186 for each revolution of the wheel 38. If the outer circumference of the wheel 38 is exactly one foot, then each time the micro-switch is engaged this will indicate the travel of one foot. The micro-switch 186 is connected by conventional wiring (not shown) to a standard counter (not shown) mounted on the external console to indicate the number of feet that the apparatus 10 has moved into the pipe. If, for example, the weld joints are 80 feet apart, and, if the change in reading on the external counter shows an advance of 80 feet, then the operator can be reasonable certain that the powder dispenser is in the proper position with respect to an uncoated weld joint, rather than at some location where two holidays or voids in the coating coincidentally happened to occur.

OPERATION

Figure 8:
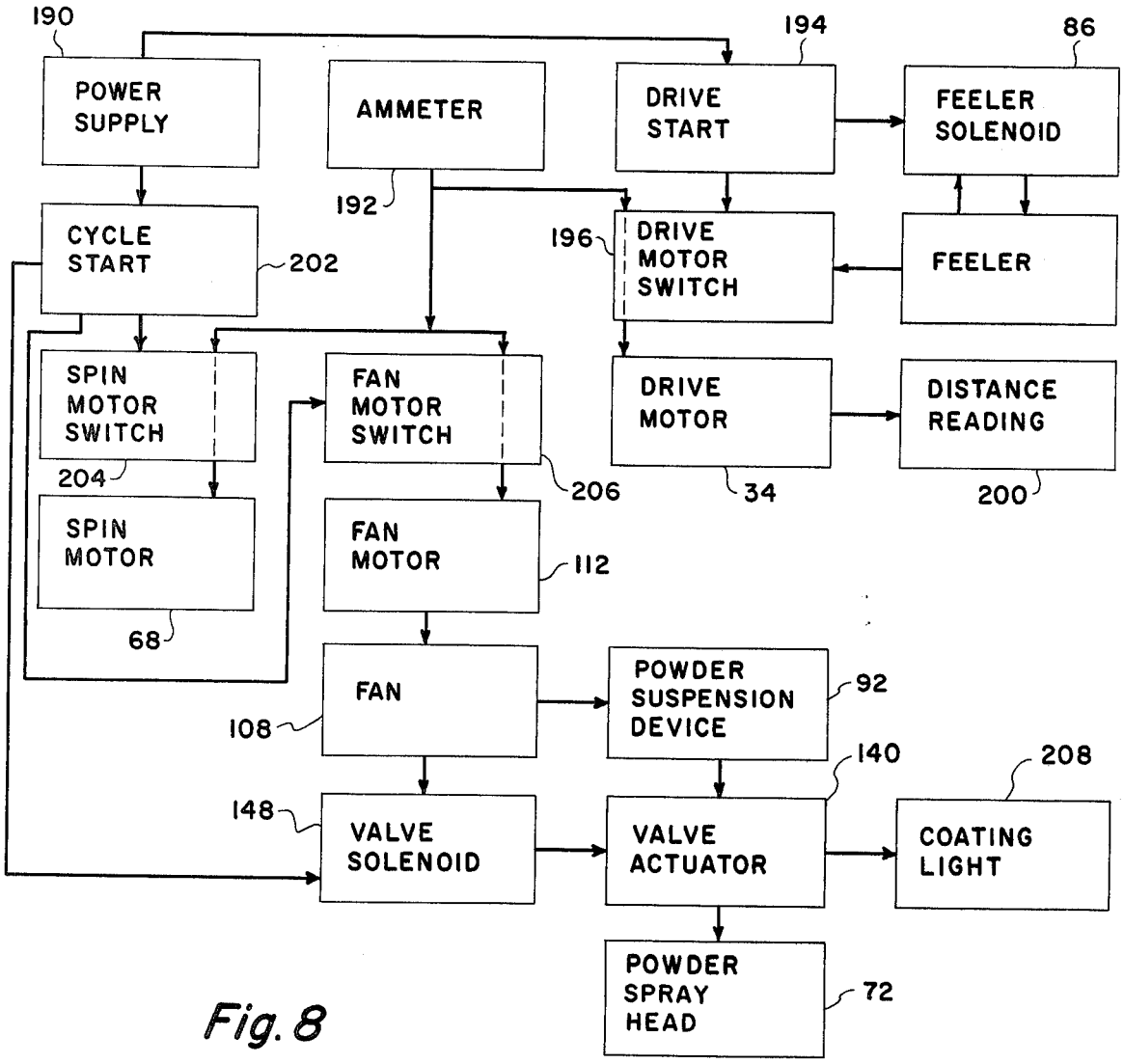
FIG. 8 is a block diagram of the circuitry employed for the operation of the present invention.

The operation of the coating apparatus 10 will now be described in reference to the preceding description and also in relation to FIG. 8. The external console (not shown) will be connected to a suitable power supply 190. The power supply for the various motors will also pass through an ammeter 192 located on the external console. Now the purpose of the ammeter is to provide an indication when the various motors begin to operate to give the operator an additional check that the apparatus is operating properly. With the apparatus located at the open end of the pipe 12 and with the power supply to the external console being on, the operator pushes a drive start button (not shown) but indicated on FIG. 8 as 194. The drive start button will do two things; first of all, it will energize a drive motor switch 196 which will provide power to the drive motor 34 from the power supply 190 through the ammeter 192. When the drive motor 34 is thus connected, a reading on the ammeter will be immediately apparent if the drive motor is operating. Secondly, the drive start button 194 provides power to the feeler solenoid 86 which lifts the feeler 76 upwardly to the position shown in FIG. 3. As the apparatus 10 proceeds towards the right, the micro-switch 186 will be successively engaged by the button 188 as the wheel 38 rotates and this will provide a distance reading on the counter 200 located on the console. When the arms 78 of the feeler 76 reach the uncoated weld joint, the relay (referred to above) will be actuated to do two things; first of all, the relay will open the drive motor switch 196 to immediately stop the drive motor 34 and engage the brake therein; secondly, this relay will de-energize the feeler solenoid 86 so as to cause the feeler 76 to drop to the position shown in FIG. 2A; at the same time, the ready light 198 will go out. A check on the distance reading counter 200 will give the operator an indication as to whether or not the apparatus 10 is in the proper position to commence the coating cycle.

At this time, the operator pushes the cycle start button 202. The cycle start button 202 energizes a clock motor (not shown) which has three internal cams and three micro-switches for operating the spin motor switch, the fan motor switch and the valve solenoid 148, as will be described below.

Thus, pushing the cycle start button 202 will cause three things to occur through the clock motor (not shown) described above; first of all, a spin motor switch 204 will be actuated to provide power from the power supply through the ammeter 192 to the spin motor 68. When the spin motor commences to operate, a reading on the ammeter 192 will show that this motor is operating. It is desirable to have the powder spray head 72 rotating before the powdered material is introduced into the hollow shaft 58. Secondly, pushing the cycle start button 202 will cause a fan motor switch 206 to be closed such that power is supplied to the fan motor 112 through the switch from the power supply 190 and the ammeter 192. An additional jump on the ammeter 192 will show that the fan motor 112 is also operating properly. At this time, the fan motor 112 will drive the fan 108 so as to provide air to the powder suspension device 92 to place the powder therein under suspension. Thirdly, when the cycle start button 202 is depressed, the valve solenoid 148 will be energized (subsequent to the actuation of the fan motor) to allow air to pass into the valve actuator 140 to open the pinch valve 118 and allow powder to pass from the powder suspension device into the powder spray head 72. At the same time, the arm 128 will be moved by the valve actuator 140 to actuate the micro-switch 146 and turn on a coating light 208 which is located on the console and which is preferably red in color. The coating light 208 will remain on during the coating operation.

The clock motor (not shown) which was actuated by the cycle start button 202, through its various cams (not shown) will operate the three micro-switches (not shown) therein to effect the following actions in the following order. First of all, the valve solenoid 148 is de-energized such that the pinch valve 118 is closed and the coating light 208 will go out; secondly, the fan motor switch 206 will be opened so it will stop the fan 108 and discontinue the supply of air to the fan suspension device. Thirdly, the spin motor switch 204 will be opened so as to stop the fan motor 68.

At this point, the apparatus 10 can be moved to the right towards the open end of the pipe. In the meantime, another section of pipe may have been welded to the pipeline. At the time of welding this additional pipe section, the power lines to the apparatus 10 can be disconnected, by means of suitable quick connect couplers (not shown) and reconnected through the new section of pipe. The drive motor is actuated in reverse direction by means of a suitable reverse switch (not shown) which will operate the drive motor without actuating the feeler solenoid.

Whereas, the present invention has been described in particular relation to the drawings attached hereto, it should be understood that other and further modifications of the invention, apart from those shown or suggested herein, may be made within the spirit and scope of this invention.

What is claimed is:

1. An internal pipe coating apparatus for coating the interior surfaces of uncoated weld joints in an otherwise internally coated pipeline comprising a frame having wheels at the forward and rear ends thereof, the forward end being oriented towards an uncoated weld joint to be coated, a drive motor for driving one pair of wheels to move the coating apparatus within the pipeline towards the uncoated weld joint, a pivotal feeler mechanism located at the forward end of said frame, said feeler mechanism including a pair of electrically conductive arms adapted to bear against the internal surface of the pipeline and to create a completed circuit when the feeler arms engage the bare surface of the uncoated weld joint to stop the drive motor, means responsive to the actuation of said drive motor for pivoting said feeler mechanism into position where said feeler arms are in contacting position against the internal surface of the pipe, a rotatable hollow shaft located at the forward end of said frame, said hollow rotatable shaft being provided with a hollow hub and a plurality of hollow radiating arms adapted to spray powder on the uncoated weld joint, a spin motor mounted on said frame for rotating said shaft, means for actuating said spin motor, a powder suspension device mounted on said frame, means for conducting a suspension of powder from said powder suspension device to said hollow hub, a fan means mounted on said frame and actuated in subsequent timed relation to the actuation of the spin motor to provide air under pressure to the powder suspension device to suspend powder therein, a valve located on said conducting means, valve operating means actuated in timed relation with and subsequent to the actuation of said fan means for opening said valve to provide a stream of powder to the hollow hub so that a suspension of powder passes out of the hollow arms by centrifugal force to coat the heated weld joint.

2. An internal pipe coating apparatus as set forth in claim 1 wherein said means for pivoting said feeler mechanism includes a solenoid actuated in timed relation to the actuation of said drive motor.

3. An internal pipe coating apparatus as set forth in claim 1 wherein said means for conducting a suspension of powder from said powder suspension device to said hollow hub includes a hollow tube extending coaxially within said rotatable shaft and forming an annular space therewith, said hollow tube having one end in communication with said valve and terminating at an opposite end within said hub, whereby, when a suspension of powder passes out of the hollow arms by centrifugal force, air is sucked into said annular space.

4. An internal pipe coating apparatus as set forth in claim 1 wherein said powder suspension device includes a closed container having a substantially horizontal foraminous plate mounted therein separating said container into an upper chamber and a lower chamber, said plate being adapted to support a quantity of powder thereon in said upper chamber, a conduit connected to said fan means and in communication with the lower chamber of said container to provide a stream of air beneath said plate so as to pass there through and suspend said powder in said upper chamber and means in communication with said upper chamber and said valve to provide a stream of powder to said valve.

5. An internal pipe coating apparatus as set forth in claim 1 including a pair of auxiliary wheels mounted adjacent the driven pair of wheels and normally out of engagement with the internal surface of said pipeline, means for moving said auxiliary wheels into engagement with the internal surface of said pipeline while simultaneously moving said driven pair of wheels out of engagement with the internal surface of said pipeline.

* * * * *